US008144918B2

(12) United States Patent
Ikeda et al.

(10) Patent No.: US 8,144,918 B2
(45) Date of Patent: Mar. 27, 2012

(54) DIAPHRAGM FOR PLANAR SPEAKER AND PLANAR SPEAKER

(75) Inventors: Hiroshi Ikeda, Tokyo (JP); Toshiya Hikami, Tokyo (JP); Toshimitsu Nishiwaki, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 1178 days.

(21) Appl. No.: 11/908,246

(22) PCT Filed: Mar. 9, 2006

(86) PCT No.: PCT/JP2006/304600

§ 371 (c)(1),
(2), (4) Date: Oct. 5, 2007

(87) PCT Pub. No.: WO2006/095814

PCT Pub. Date: Sep. 14, 2006

(65) Prior Publication Data

US 2008/0087493 A1 Apr. 17, 2008

(30) Foreign Application Priority Data

Mar. 9, 2005 (JP) ..... 2005-065682
Mar. 6, 2006 (JP) ..... 2006-059974

(51) Int. Cl.
*H04R 1/00* (2006.01)
*H04R 25/00* (2006.01)

(52) U.S. Cl. ..... 381/423; 381/152; 381/191; 381/398; 381/408; 381/431

(58) Field of Classification Search ..... 381/423, 381/431, 152, 398, 191, 408
See application file for complete search history.

(56) References Cited

U.S. PATENT DOCUMENTS

| | | | | |
|---|---|---|---|---|
| 3,873,784 | A * | 3/1975 | Doschek | 381/186 |
| 4,037,061 | A * | 7/1977 | von Recklinghausen | 381/408 |
| 4,272,653 | A * | 6/1981 | Osato et al. | 381/425 |
| 4,281,223 | A * | 7/1981 | Ugaji et al. | 381/408 |
| 4,471,173 | A * | 9/1984 | Winey | 381/408 |
| 4,837,838 | A * | 6/1989 | Thigpen et al. | 381/408 |
| 4,924,504 | A * | 5/1990 | Burton | 381/427 |
| 5,003,610 | A * | 3/1991 | Adachi et al. | 381/431 |
| 5,297,214 | A * | 3/1994 | Bruney | 381/431 |
| 5,627,903 | A * | 5/1997 | Porrazzo et al. | 381/423 |
| 6,097,829 | A * | 8/2000 | Guenther et al. | 381/425 |
| 6,097,830 | A * | 8/2000 | Zelinka et al. | 381/431 |
| 6,593,847 | B2 * | 7/2003 | Miyazaki et al. | 340/388.1 |
| 6,654,475 | B2 * | 11/2003 | Nakaso | 381/396 |
| 6,760,462 | B1 * | 7/2004 | Thigpen | 381/431 |
| 6,895,097 | B2 * | 5/2005 | Furuyama | 381/152 |

(Continued)

FOREIGN PATENT DOCUMENTS

EP 1 489 881 A1 12/2004

(Continued)

*Primary Examiner* — Elvin G Enad
*Assistant Examiner* — Christina Russell
(74) *Attorney, Agent, or Firm* — Oblon, Spivak, McClelland, Maier & Neustadt, L.L.P.

(57) ABSTRACT

A diaphragm for a planar speaker and a planar speaker having a long-term stability and a high reliability and exhibiting a flat sound pressure frequency property. The diaphragm for a planar speaker includes a voice coil formed by winding a wire conductor, two adhesive layers sandwiching the voice coil therebetween, and bases bonded to the two adhesive layers on the side opposite to the voice coil. The planar speaker employs the diaphragm.

8 Claims, 9 Drawing Sheets

U.S. PATENT DOCUMENTS

| | | | | |
|---|---|---|---|---|
| 6,929,091 | B2 * | 8/2005 | Bertagni et al. | 181/150 |
| 7,283,636 | B2 * | 10/2007 | Nishimura et al. | 381/152 |
| 7,864,977 | B2 * | 1/2011 | Sadaie et al. | 381/407 |
| 7,912,239 | B2 * | 3/2011 | Nishimura et al. | 381/396 |
| 2001/0048256 | A1 * | 12/2001 | Miyazaki et al. | 310/81 |
| 2002/0191808 | A1 * | 12/2002 | Croft et al. | 381/431 |
| 2004/0246109 | A1 * | 12/2004 | Suzuki et al. | 340/384.1 |
| 2005/0036647 | A1 * | 2/2005 | Nguyen et al. | 381/423 |
| 2005/0036648 | A1 * | 2/2005 | Nguyen et al. | 381/424 |
| 2005/0041830 | A1 * | 2/2005 | Takewa et al. | 381/410 |
| 2005/0152577 | A1 * | 7/2005 | Nishimura et al. | 381/431 |
| 2007/0127767 | A1 * | 6/2007 | Croft et al. | 381/422 |
| 2010/0215208 | A1 * | 8/2010 | Sadaie et al. | 381/407 |
| 2011/0200204 | A1 * | 8/2011 | Horigome et al. | 381/86 |

FOREIGN PATENT DOCUMENTS

| | | | |
|---|---|---|---|
| EP | 1489881 | A1 * | 12/2004 |
| JP | 9 504921 | | 5/1997 |
| JP | 2001 126942 | | 5/2001 |
| JP | 2002 204495 | | 7/2002 |
| JP | 2003 284187 | | 10/2003 |
| WO | 03 073787 | | 9/2003 |

* cited by examiner

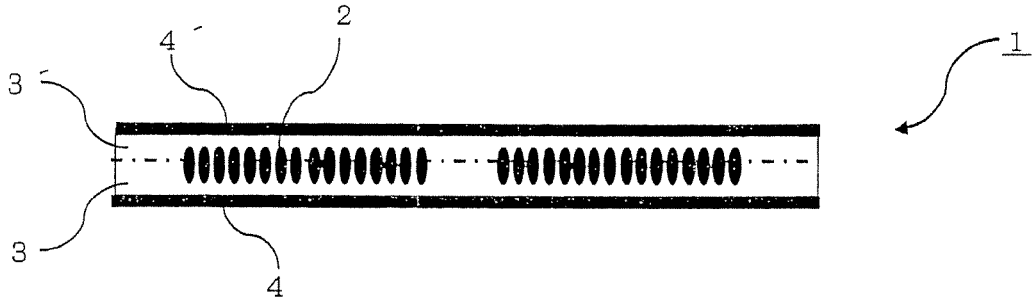
2
4
1
3
3
4

DIAPHRAGM FOR PLANAR SPEAKER AND PLANAR SPEAKER

TECHNICAL FIELD

The present invention relates to a diaphragm for thin planar speaker and a planar speaker using the same required having a high sound pressure and a long-term reliability.

BACKGROUND ART

FIG. 6 shows an example of a conventional thin planar speaker. This speaker includes a yoke 50; a plurality of bar-shaped magnets 52 which are arranged in parallel on the yoke 50; a diaphragm 54 which is arranged in parallel with the pole faces of the bar-shaped magnets 52; and a plurality of coils 56 which are arranged on the diaphragm 54 at positions facing the bar-shaped magnets 52 such that current flows in a direction perpendicular to a magnetic field generated from the bar-shaped magnets 52. When alternating current is caused to flow through each of the coil 56, according to Fleming's left hand rule, force is generated between the coil 56 and the magnetic field, with the result that the diaphragm 54 is vibrated in a direction perpendicular to the surface of the diaphragm. That is, by causing alternating current to flow through the coil 56 in accordance with predetermined electrical signals, the electrical signals are converted into sound signals.

However, the above-described planar speaker involves problems, including generation of noise resulting from twisting of the diaphragm 54 due to force along the surface of diaphragm 54, which force occurs by the effect of the magnetic field perpendicular to the surface of the diaphragm 54, since, for example, the coils 56 facing the bar-shaped magnets 52 have an elongated rectangular shape, and most portions of the coils 56 are located in regions facing the pole faces of the bar-shaped magnets 52.

In an attempt to improve the planar speaker of FIG. 6 involving the above-mentioned problem, a planar speaker having a configuration shown in FIG. 7 has been proposed. In the planar speaker having this configuration, a plurality of magnets 62 are arranged on a yoke 60 in parallel with a diaphragm 64 such that the pole faces of adjacent magnets differ from each other. Furthermore, a plurality of spiral coils 66 are arranged on a surface of the diaphragm 64 on the side facing the magnets 62, such that the innermost circumference of each of the spiral coils is positioned in the vicinity of a portion of the diaphragm, the portion corresponding to the outer periphery of each of the pole faces.

With the configuration of the planar speaker described above, force which the coils 66 receive from a magnetic field perpendicular to the diaphragm 64 is reduced, and generation of noise is suppressed. In addition, the portions of the coil 66 that are perpendicular to a magnetic field in parallel with the diaphragm are increased in area, whereby sound conversion efficiency is enhanced, and sound pressure which is a yardstick for sound conversion efficiency is increased.

However, the planar speaker shown in FIG. 7 involves problems of noise and sound pressure, etc. An improved technique for the planar speaker involving such problems has been proposed in Patent document 1. This document discloses a planar speaker having voice coils formed by employing a wiring technique disclosed by Patent document 2.

The wiring technique disclosed in Patent document 2 is the technique in which a wiring head which is provided so as to be movable relative to the surface of a sheet-like base having an adhesive layer on at least one surface thereof (hereinafter referred to as "adhesive sheet) is intermittently brought into point contact with the surface of the adhesive sheet, while a wire conductor is fed from the wiring head, thereby attaching the wire conductor onto the surface of the adhesive sheet in a sequential manner.

With use of the above-described wiring technique, spiral voice coils are provided on the adhesive layer of the adhesive sheet, and then another sheet having the same adhesive layer as that of the adhesive sheet is bonded to the adhesive sheet with the voice coils sandwiched therebetween such that the adhesive layers thereof adhere to each other, thereby faulting a diaphragm. The planar speaker described in Patent document 1 is composed of the thus-formed diaphragm and magnets provided at a position facing the voice coils.

Patent document 1: Japanese Patent Application Publication No. 2003-284187

Patent document 2: Japanese Patent Application Publication No. 2001-126942.

SUMMARY OF THE INVENTION

Problems to be Solved by the Invention

However, in the planar speaker described in Patent document 1, the spiral voice coils as driving source are simply bonded to the sheet-like base or a insulating base film with the adhesive, and there is an issue that the temperature of a wire conductor constituting the spiral voice coil increases in a long-term use, and tackiness of the adhesive layers is lowered. The lowering of tackiness of the adhesive may cause separation of the spiral voice coils from the sheet-like base or insulating base film and generation of abnormal noise, which involves a great problem of reliability.

The present invention has been made under the above circumstances. An object of the present invention is to provide a diaphragm for planar speaker and a planar speaker having a long-term stability and a high reliability and exhibiting a flat sound pressure frequency property.

Means for Solving the Problems

A first aspect of the present invention is a diaphragm for a planar speaker, which includes: a voice coil layer including at least one voice coil formed by winding a wire conductor; lead lines for drawing both ends of the voice coil to the outside; one or two adhesive layers formed on either one or both of surfaces of the voice coil layer; and one or two bases bonded to one or two surfaces of the one or two adhesive layers opposite to the voice coil layer.

A second aspect of the present invention is a diaphragm in which the aforementioned one or two adhesive layers include an epoxy resin component, or alternatively one of the two adhesive layers includes an epoxy resin component and the other adhesive layer includes an acrylic resin component.

A third aspect of the present invention is a diaphragm in which the aforementioned one or two adhesive layers include an acrylic resin component.

A fourth aspect of the present invention is a diaphragm in which the aforementioned one or two bases are formed of a resin foam sheet which includes at least one thermoplastic resin and has a single or multiple foam layers having microbubbles of an average bubble diameter of 50 μm or less.

A fifth aspect of the present invention is a diaphragm in which the aforementioned one or two bases are formed of a sheet selected from the group consisting of:

(i) a uniform sheet including one of a plastic film, metallic foil, and fiber in a form of woven or non-woven fabric, or paper;

(ii) a sheet being formed such that the uniform sheet is impregnated or coated with a thermosetting resin and cured; and (iii) a sheet being formed such that the uniform sheet is impregnated or coated with acrylic resin in advance.

A sixth aspect of the present invention is a diaphragm in which connection portions of the aforementioned lead lines and external wirings are attached firmly to the aforementioned one adhesive layer or sandwiched between the aforementioned two adhesive layers integrally with the aforementioned voice coil.

A seventh aspect of the present invention is a diaphragm in which one of the aforementioned two adhesive layers and one of the aforementioned two bases are shortened by a predetermined width from end of one side of the other adhesive layer and the other base, the one side being a side from which the aforementioned lead lines are drawn.

A eighth aspect of the present invention is a diaphragm in which the aforementioned predetermined width is equal to or less than an adhesive overlap width between the diaphragm and an edge of a holder for holing the diaphragm.

A ninth aspect of the present invention is a planar speaker which includes the diaphragm according to any one of the first aspect to the eighth aspect of the present invention.

Effect of the Invention

According to the present invention, there is provided a diaphragm for planar speaker and a planar speaker which has no possibility of separation of the two adhesive layers sandwiching the voice coil therebetween in long-term use and exhibits a flat sound pressure frequency property.

In addition, in the case of one of the two adhesive layers and one of the two bases are shortened by a predetermined width from end of one side of the other adhesive layer and the other base, the one side being a side from which the lead lines are drawn, if bending the lead lines in an extra-length treatment, line breakage does not occur, and thus there is obtained an advantageous effect of enhanced reliability of the diaphragm and the planar speaker.

BRIEF DESCRIPTION OF THE DRAWINGS

FIG. 1 is a cross sectional view showing a diaphragm for planar speaker according to a first embodiment of the present invention;

FIG. 2A is a plane view showing a planar speaker using a diaphragm for planar speaker of the present invention;

FIG. 2B is a cross sectional view showing a planar speaker using a diaphragm for planar speaker of the present invention;

FIG. 2C is a plane view showing a planar speaker using a diaphragm for planar speaker of the present invention;

EXPLANATION OF SYMBOLS

Figure 3:
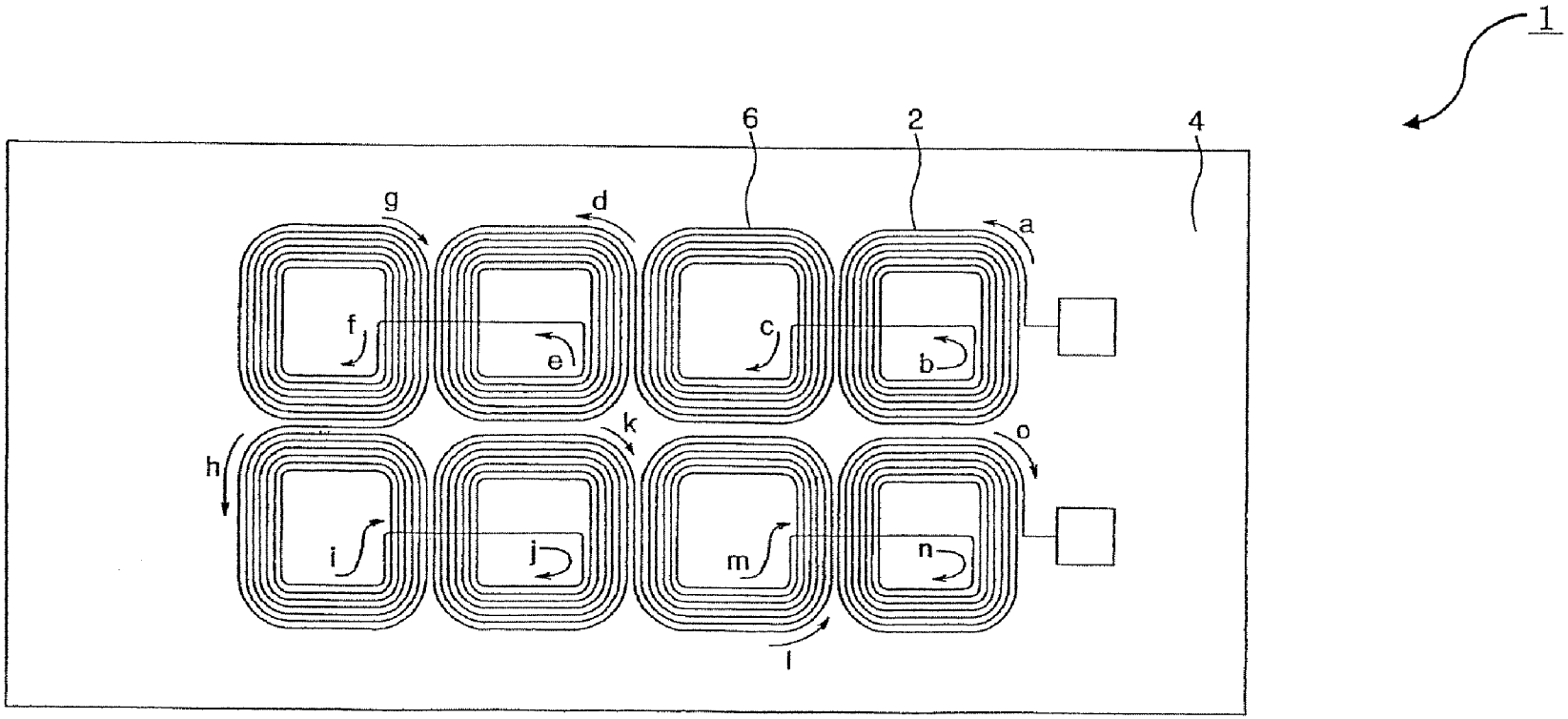
FIG. 3 is a plane view showing a planar speaker including voice coils attached thereto.

1, 20 diaphragm for planar speaker
2 voice coil
3 adhesive layer
4, 21 base
5 yoke
6 magnet
7 UV tape
10 planar speaker
22 lead line
23 end portion
24 opening region
25 cured portion
26 edge

BEST MODE FOR CARRYING OUT THE INVENTION

With reference to the drawings, one embodiment of a diaphragm for planar speaker and a planar speaker according to the present invention will be described below. FIG. 1 shows a cross sectional view of a diaphragm for planar speaker according to the present embodiment of the present invention. As shown in FIG. 1, a diaphragm 1 for planar speaker according to the present embodiment is configured such that a voice coil 2 formed by winding a wire conductor is interposed between two adhesive layers 3 and 3', and base 4 and 4' are bonded to outer surfaces of the adhesive layers 3 and 3'.

The diaphragm 1 for planar speaker can be formed by, for example, the following procedure. Firstly, the voice coil 2 formed by winding a wire conductor is formed on an adhesive surface of either one of the two adhesive layers 3 and 3', for example, the adhesive layer 3 in this case. The adhesive layers 3 and 3' may be formed of any of an ultraviolet (UV) curable tape, an epoxy tape of epoxy resin or epoxy-rubber blended composition, an acryl resin tape, and a tape formed of epoxy-acryl blended resin composition. Preferably, at least one of the adhesive layers 3 and 3' includes epoxy resin as a main component.

Use of any of epoxy resin, acryl resin and blended resin thereof as main component of the adhesive layers 3 and 3' makes it possible to enhance the adhesive force of the adhesive layers 3 and 3' and prevent the lowering of tackiness of the adhesive surface.

The base member 4 may be formed of various polymer such that polyetherimide, polyimide, polyester, liquid-crystal polymer, polyphenylene sulfide, nylon, and wholly aromatic polyamide (hereinafter referred to as "aramid"). Alternatively, as the base member 4, it is possible to use a laminated member having any of the various polymer films described above and, laminated on one surface thereof, any of paper, glass cloth, aramid fabric, aramid non-woven fabric, and the like. In addition, it is also possible to use a prepreg being formed such that the woven or non-woven fabric described above is impregnated with a thermosetting resin.

As a method for forming the voice coil 2 on the adhesive surface of the adhesive layer 3, for example, the wiring method proposed in Japanese patent application publication No. 2001-126942 can be used. Specifically, a wiring head which is provided so as to be movable relative to the surface of the adhesive layer 3 is intermittently brought into point contact with the surface of the adhesive layer 3, while a wire conductor is fed from the wiring head, thereby attaching the wire conductor onto the surface of the adhesive layer 3. As a result, the voice coil 2 is formed on the surface of the adhesive layer 3.

Next, the adhesive surface of the other adhesive layer 3' is bonded to the adhesive surface of the adhesive layer 3 having the voice coil 2 formed thereon, thereby sandwiching the voice coil 2 between the two adhesive layers 3 and 3'. In order to reduce the warpage of the diaphragm 1 due to the thermal history thereof, the adhesive layer 3' is preferably formed of equivalent material to the adhesive layer.

As described above, the adhesive layers 3 and 3' are respectively bonded to the both surfaces of the voice coil 2, thereby preventing the voice coil 2 from being exposed to the outside. This makes it possible to enhance the adhesive strength for holding the voice coil and prevent the separation of the two adhesive layers 3 and 3' even in long-term use.

Next, one or both of the bases 4 and 4' are bonded to one or both of the surfaces of the adhesive layers 3 and 3' opposite to the voice coil 2 (i.e. the outer surfaces of the adhesive layer). The bases 4 and 4' serve to protect the voice coil 2 sandwiched between the adhesive layers 3 and 3' and improve the stiffness of the entire diaphragm 1.

Preferably, each of the bases 4 and 4' may be a resin foam sheet which includes one or more thermoplastic resins and has a single or multiple foam layers having microbubbles of the average bubble diameter of 50 μm or less, more preferably 5 μm or less.

Alternatively, each of the bases 4 and 4' may be a sheet selected from the group consisting of:

(i) a uniform sheet such as a plastic film, metallic foil, and fiber in a form of woven or non-woven fabric, or paper, (ii) a prepreg sheet being formed such that the uniform sheet described above is impregnated with a thermosetting resin in advance, and (iii) a sheet being formed such that the uniform sheet is coated with acrylic resin in advance.

Whatever is selected from the above sheets as the base 4 and 4', the reliability of the diaphragm 1 can be ensured by thermally curing the entire diaphragm 1 or fixing the voice coil 2 with the adhesive layers 3 and 3'.

Forming the base 4 and 4' with use of the resin foam sheet described above leads to increase in stiffness and decrease in weight of sheet per unit area, compared to use of the conventional non-foam sheet as a base. This makes it possible to simultaneously improve both vibration distortion property and sound pressure. In the case of the multiple foam layers, the stiffness can be further increased and the vibration distortion property can be further improved. Further, in case of using the resin foam sheet formed of one or more thermoplastic polyester resins as the bases 4 and 4', there can be provided a diaphragm for planar speaker with high heat resistance and high water resistance.

Two lead lines drawn from both ends of the voice coil 2 is provided in advance to connect the both ends of the voice coil to external wirings. In the diaphragm 1 for planar speaker according to the present embodiment, two connection portions of the lead lines and the external wirings are sandwiched between the adhesive layers 3 and 3'. With the above-described configuration of the diaphragm according to the present embodiment, areas of the connection portions are fixed, and thus troubles such as line breakage and the like are prevented. Accordingly, reliability in long-term driving is significantly improved.

In the case of using an insulating coating conductor whose surface layer has at least one insulating layer as the conductive wire constituting the voice coil 2, the wire conductor can be arranged to be stacked upon itself, and thus the wire conductor can be laid in dense and can be arranged across itself. This makes it possible to enhance sound conversion efficiency of the diaphragm 1 and increase the degree of freedom in the design of shape.

One embodiment of a planar speaker of the present invention using the diaphragm 1 of the above-described embodiment is shown in FIGS. 2A to 2C. In a planar speaker 10, a plurality of magnets 6 are arranged on a yoke 5 in parallel with the diaphragm 1 such that the pole faces of adjacent magnets 6 differ from each other. A plurality of voice coils 2 formed in the diaphragm are arranged such that the innermost circumference of each of the voice coils 2 is positioned in the vicinity of a portion of the diaphragm 1, the portion corresponding to the outer periphery of each of the pole faces. Arrangement of the voice coil 2 is shown in FIG. 3.

Example 1

Description is made about an example of the diaphragm 1 according to the above embodiment and the planar speaker 10 using the same with reference to FIGS. 2A to 2C.

In FIGS. 2A to 2C, the planar speaker 10 includes the yoke 5, the plurality of magnets 6 mounted on one surface of the yoke 5 such that the magnetic axes are perpendicular to the yoke surface, and the diaphragm 1 described in the above embodiment.

The magnets 6 are arranged at predetermined intervals in planar direction of the yoke 5 such that the pole faces of adjacent magnets 6 are of opposite polarity. For example, neodymium magnet having a size of 7 mm (width)×7 mm (length)×2.5 mm (thickness) can be used as the magnets 6. In FIGS. 2A to 2C, the magnets 6 having the above-mentioned size are arranged two wide by four long (total of eight magnets).

The diaphragm 1 is arranged to face the magnets 6 and includes, as explained with reference to FIG. 1, the voice coils 2 formed by winding a wire conductor, the adhesive layers 3 and 3' sandwiching the voice coil 2 therebetween, and the bases 4 and 4' bonded to the surfaces of the adhesive layers 3 and 3' opposite to the voice coil 2.

An example of manufacturing method of the diaphragm 1 for planar speaker as Example 1 is made below with reference to FIGS. 4A to 4E.

Figure 4A:
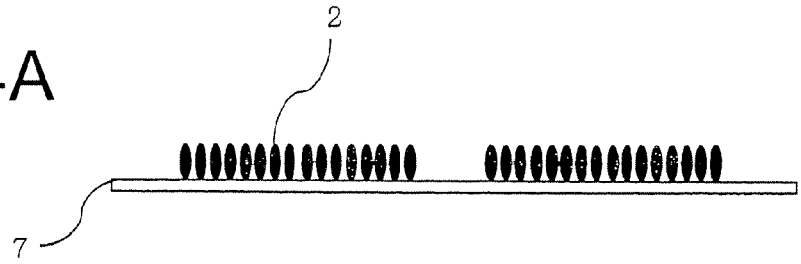
FIGS. 4A to 4E are views showing an example of a manufacturing process of a diaphragm for planar speaker of the present invention.
Figure 4B:
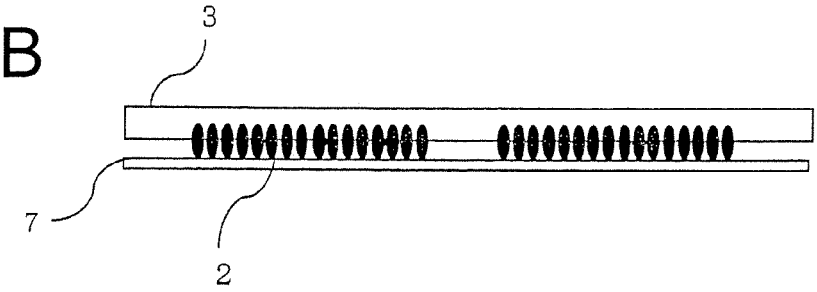

For example, a copper-clad aluminum wire with diameter of 0.19 mm is used as a wire conductor constituting the voice coils 2. This wire is applied onto, for example, an ultraviolet (UV) curable tape 7 in a coiled pattern as shown in FIG. 3, thereby forming the voice coil 2 as shown in FIG. 4A. After the voice coil 2 is formed on the UV tape 7, the adhesive layer 3 having the same dimensions as those of the UV tape 7 is bonded to the voice coil 2 as shown in FIG. 4B. For the adhesive layer 3, a tape formed of epoxy resin can be used.

Figure 4C:
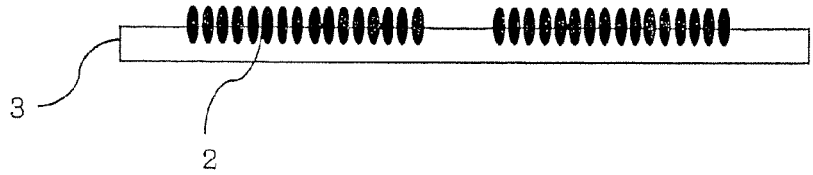

By bonding the adhesive layer 3 to the voice coil 2 as shown in FIG. 4B, the voice coil 2 is firmly attached to the adhesive surface of the adhesive layer 3. Thereafter, the voice coil 2 is transferred to the adhesive layer 3 by irradiating the back surface of the UV tape 7 with ultraviolet rays and separating the UV tape 7 from the voice coil 2, as shown in FIG. 4C.

Figure 4D:
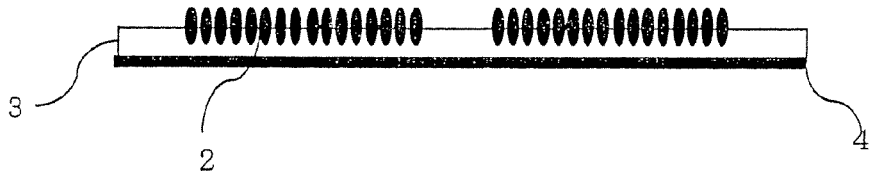

Then, the base 4 having the same dimensions as those of the adhesive layer 3 is bonded to the surface of the adhesive layer 3 opposite to the voice coil 2 as shown in FIG. 4D. A PEN resin foam sheet was used.

Separately, the adhesive layer 3' differing from the adhesive layer 3 to which the voice coil 2 has been transferred is bonded to the adhesive layer 3 with the voice coil 2 sandwiched therebetween. Another base 4' is, in advance, bonded to the surface of the adhesive layer 3' opposite to the surface to be bonded to the adhesive layer 3. The same epoxy rein tape as for the adhesive layer 3 was used for the adhesive layer 3', and the same PEN resin foam sheet as for the base 4 was used for the base 4'.

Figure 4E:
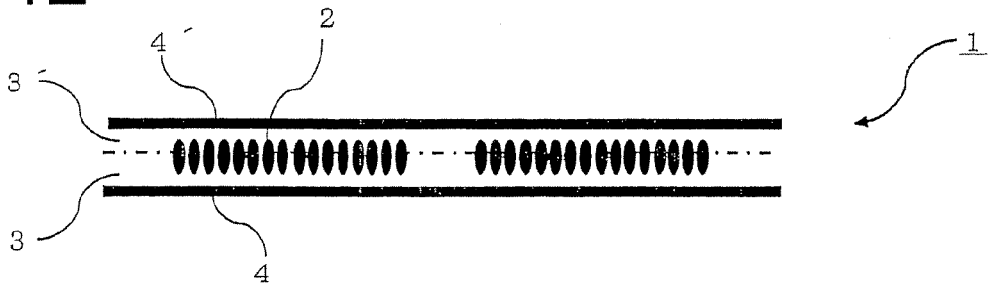

The structure having the voice coil 2, the adhesive layers 3 and 3' with the voice coil 2 sandwiched therebetween, and the bases 4 and 4' bonded to the outer surface of the adhesive layers 3 and 3 as described above is thermally cured through heat-pressing at 150 degree C. for one hour, whereby the diaphragm 1 for planar speaker is produced as shown in FIG. 4E.

Incidentally, each of the voice coils 2 of the diaphragm 1 for planar speaker shown in FIG. 3 has seven wire turns, outer peripheral dimensions of 10 mm×10 mm, and inner peripheral dimensions of 5 mm×5 mm.

The bases 4 and 4' used in this example are resin foam sheets having microbubbles uniformly formed therein and can be produced as follows. Firstly, the PEN sheet having a thickness of 0.3 mm is sealed in a high-pressure vessel, and carbon dioxide gas of 60 kg/cm$^2$ is injected into the vessel. Then, the vessel is left to stand for seven days at room temperature, so that the PEN sheet is penetrated and saturated with carbon dioxide gas. Then, the sheet is taken out from the vessel after releasing the pressure and put in a circulating hot air oven for foaming a resin set at 180 degree C. for one minute to foam the PEN resin, thereby producing the resin foam sheet.

Example 2

Another example of manufacturing method of the diaphragm 1 for planar speaker as Example 2 is made below with reference to FIGS. 4A to 4E. Similar to Example 1, a copper-clad aluminum wire with diameter of 0.19 mm is used as a wire conductor. This wire is applied onto the ultraviolet (UV) curable tape 7 in a coiled pattern as shown in FIG. 3, thereby forming the voice coil 2 as shown in FIG. 4A. After the voice coil 2 is formed on the UV tape 7, the adhesive layer 3 having the same dimensions as those of the UV tape 7 is bonded to the voice coil 2 as shown in FIG. 4B. For the adhesive layer 3, a tape formed of epoxy resin can be used.

By bonding the adhesive layer 3 to the voice coil 2 as shown in FIG. 4B, the voice coil 2 is firmly attached to the adhesive surface of the adhesive layer 3. Thereafter, the voice coil 2 is transferred to the adhesive layer 3 by irradiating the back surface of the UV tape 7 with ultraviolet rays and separating the UV tape 7 from the voice coil 2, as shown in FIG. 4C.

Then, the base 4 having the same dimensions as those of the adhesive layer 3 is bonded to the surface of the adhesive layer 3 opposite to the voice coil 2 as shown in FIG. 4D. A polyetherimide film (25 μm) was used.

Separately, the adhesive layer 3, differing from the adhesive layer 3 to which the voice coil 2 has been transferred is bonded to the adhesive layer 3 with the voice coil 2 sandwiched therebetween. Another base 4' is, in advance, bonded to the surface of the adhesive layer 3' opposite to the surface to be bonded to the adhesive layer 3. The same epoxy rein tape as for the adhesive layer 3 was used for the adhesive layer 3', and the same polyetherimide film (25 μm) for the base 4 was used for the base 4'.

The structure having the voice coil 2, the adhesive layers 3 and 3' with the voice coil 2 sandwiched therebetween, and the bases 4 and 4' bonded to the outer surface of the adhesive layers 3 and 3 as described above is thermally cured through heat-pressing at 150 degree C. for one hour, whereby the diaphragm 1 for planar speaker is produced as shown in FIG. 4E. Incidentally, each of the voice coils 2 of the diaphragm 1 for planar speaker shown in FIG. 3 has seven wire turns, outer peripheral dimensions of 10 mm×10 mm, and inner peripheral dimensions of 5 mm×5 mm.

Description is made about an example of conventional diaphragm for planar speaker (hereinafter referred to as "Comparative example), for comparison with the diaphragms 1 of Examples 1 and 2. A diaphragm of Comparative example is formed by applying a wire conductor onto a given sheet, in a manner similar to that of Examples. Specifically, a silicone-based adhesive is attached to a PEN film, and a copper-clad aluminum wire with diameter of 0.19 mm is applied onto the adhesive layer of the adhesive in coiled pattern, thereby forming voice coils of Comparative example.

Then, a PEN resin foam sheet having a silicone-based adhesive attached thereto in advance and having the same dimensions as those of the PEN film is bonded to the PEN film such that the silicone-based adhesives thereof together sandwich the voice coils, thereby producing the diaphragm of Comparative example. In the diaphragm of Comparative example thus formed, each of the voice coils has seven wire turns, outer peripheral dimensions of 10 mm×10 mm, and inner peripheral dimensions of 5 mm×5 mm, similar to Examples.

The planar speakers 10 respectively including the diaphragm 1 of Example 1 and 2 and the conventional planar speaker including the diaphragm of Comparative example thus produced were subjected to sound testing. The result of sound testing is described below with reference to FIGS. 5A to 5C. In the sound testing, each of the planar speakers 10 and the planar speaker of Comparative example was fixed onto the center portion of a wooden plate having a size of 270 mm (width)×380 mm (length)×10 mm (thickness) and was subjected to measurement in a simple anechoic room.

Figure 5A:
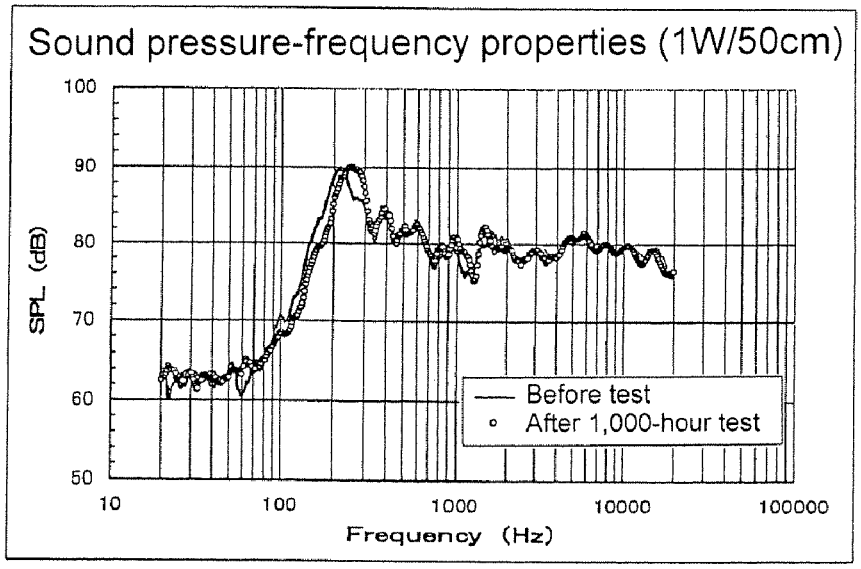
FIG. 5A is a graph showing sound pressure frequency properties of a diaphragm of Example 1 of the present invention.
Figure 5B:
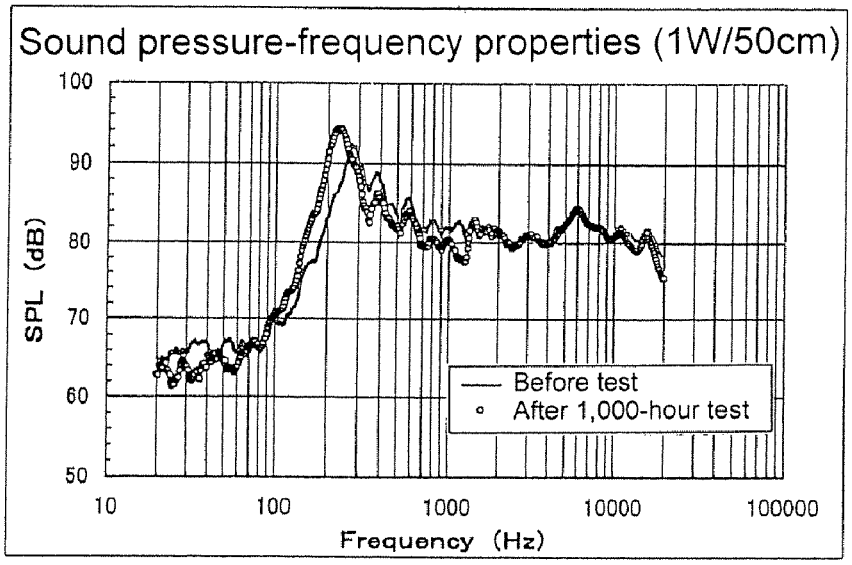
FIG. 5B is a graph showing sound pressure frequency properties of a diaphragm of Comparative example.
Figure 5C:
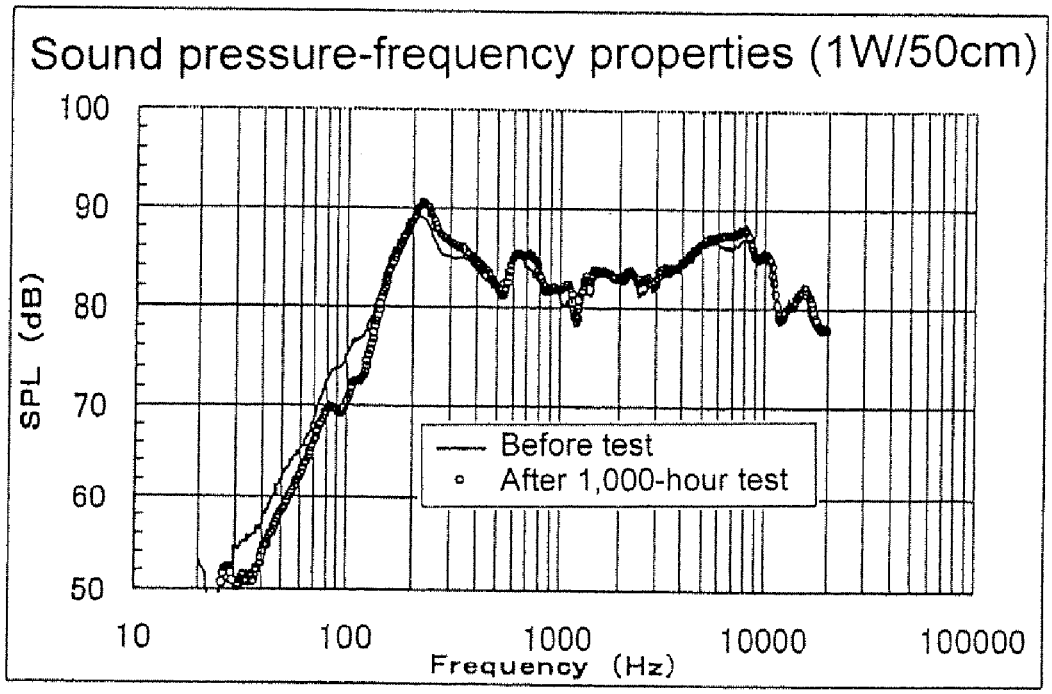
FIG. 5C is a graph showing sound pressure frequency properties of a diaphragm of Example 2 of the present invention.
Figure 6:
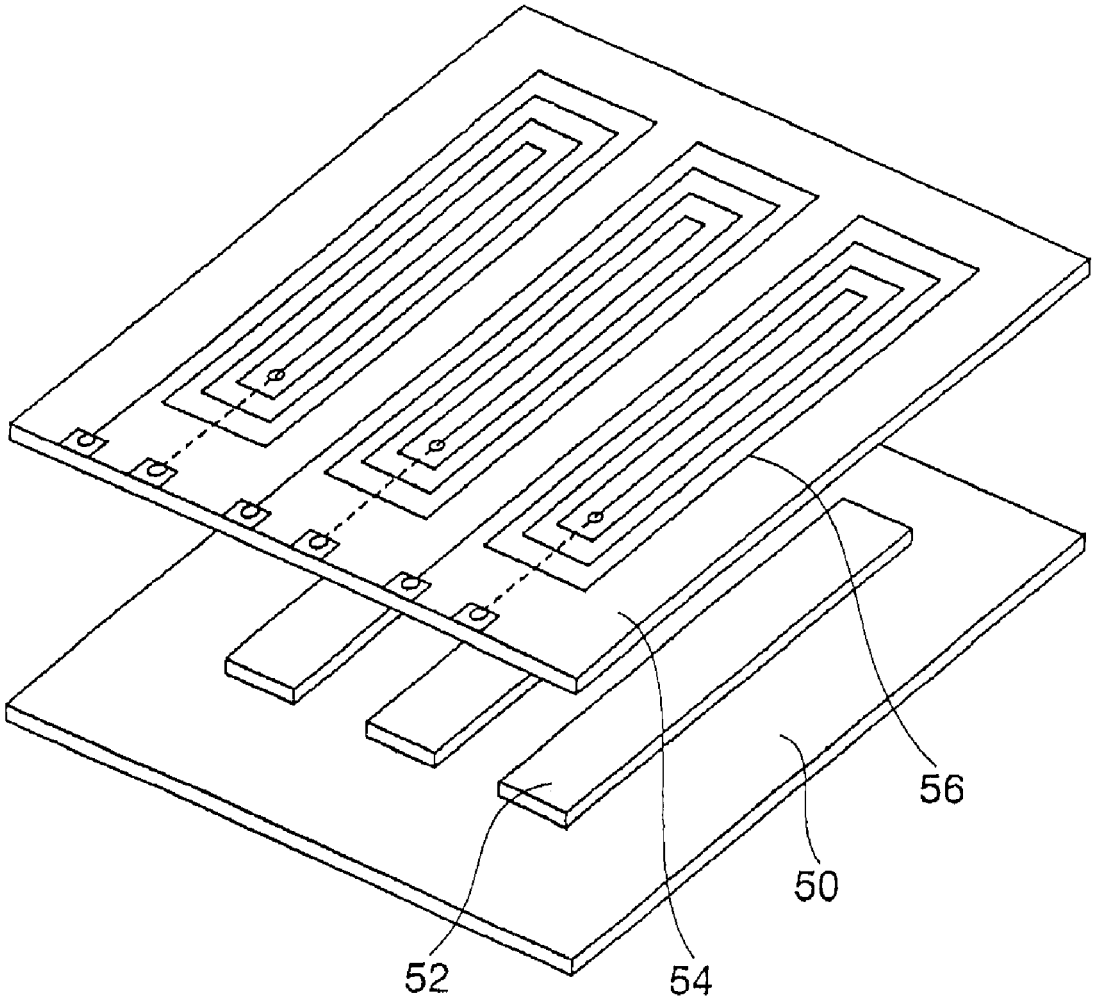
FIG.6 Background Art
FIG. 6 is a perspective view showing an example of conventional thin planar speaker.
Figure 7:
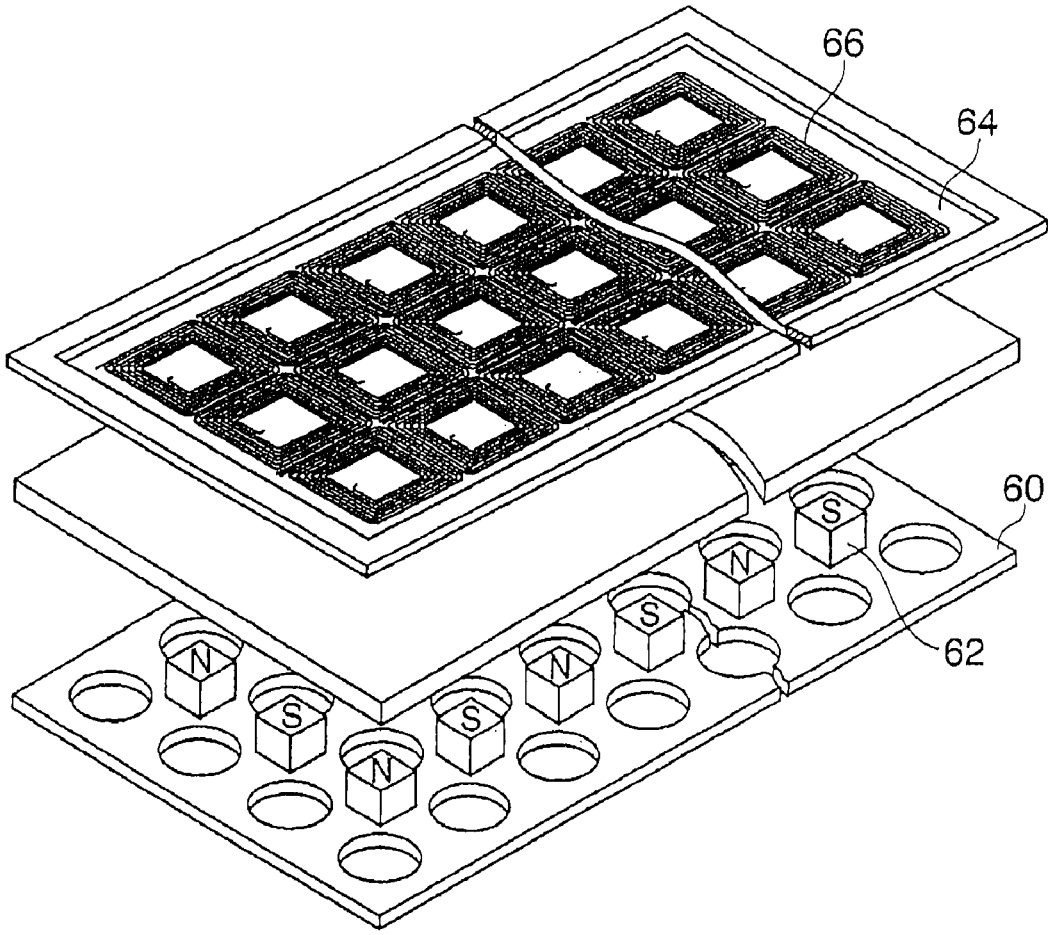
FIG.7 Background Art
FIG. 7 is a perspective view showing another example of conventional thin planar speaker.

FIGS. 5A to 5C show the results of measurement of sound pressure-frequency properties of the speakers, as measured under the following conditions: measurement power: 1 W, measurement distance: 50 cm. FIG. 5A shows the sound pressure-frequency properties of the planar speaker 10 of Example 1, FIG. 5B shows the sound pressure-frequency properties of the planar speaker of Comparative example, and FIG. 5C shows the sound pressure-frequency properties of the planar speaker 10 of Example 2. From FIG. 5A to 5C, it is found that, with respect to each of the speakers 10 of Examples 1 and 2, the peak top of sound pressure at around f0 is lowered, and thus the Q value is lowered as compared with that of Comparative example, resulting in flattening of sound pressure-frequency property.

The reason why each of the planar speakers 10 of Examples 1 and 2 exhibits the flat sound pressure frequency property as compared with that of Comparative example is because epoxy rein is used for each of the adhesive layers 3 and 3' in the diaphragm 1, whereas the silicone-based adhesives is used for adhesive layers in the diaphragm of Comparative example, and therefore the planar speaker 10 has a higher stiffness and is superior in piston motion.

In addition, the planar speakers 10 of Examples 1 and 3 and the planar speaker of Comparative example were subjected to a rated 1,000-hour continuous driving test as a reliability test under the conditions of specified environmental temperatures (60 degree C. and −10 degree C.). The results of the 1,000-hour continuous driving test are also shown in FIGS. 5A to 5C. By comparison of the sound pressure-frequency properties obtained before and after the 1,000-hour continuous driving test, in the planar speaker including the diaphragm of Comparative example, there was a change in acoustic characteristics such as lowering of sound pressure and change of f0, and abnormal noise was generated because of separation of the PEN film from the base of the diaphragm. In contrast, in each of the planar speakers 10 of Examples 1 and 2, there was little change in acoustic characteristics before and after the 1,000-hour continuous driving test, and no deterioration of the diaphragm 1 was observed.

Figure 8A:
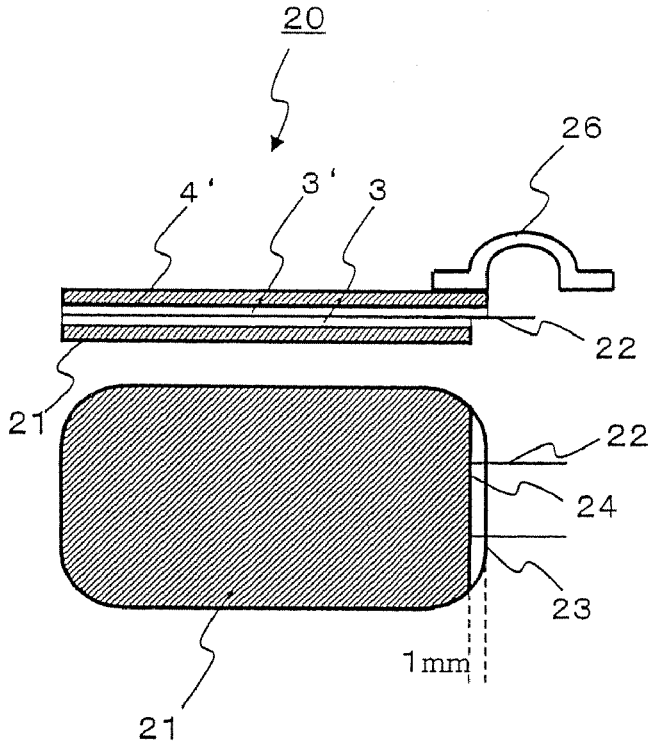
FIG. 8A is a plane and cross sectional view showing a diaphragm for planar speaker according to another embodiment of the present invention.

Next, another embodiment of a diaphragm for planar speaker according to the present invention will be described below with reference to the drawings. In the diaphragm 1 for planar speaker of the above-described embodiment shown in FIG. 1, all of the adhesive layers 3 and 3' bonded to each other with the voice coils 2 interposed therebetween and the bases 4 and 4' have the same planar shape and the same dimensions. On the other hand, a diaphragm of this embodiment has a configuration such that the planar shape and dimensions of either one of the bases 4 and 4' are changed. FIG. 8A shows a plane and cross sectional view of the diaphragm of this embodiment.

Figure 8B:
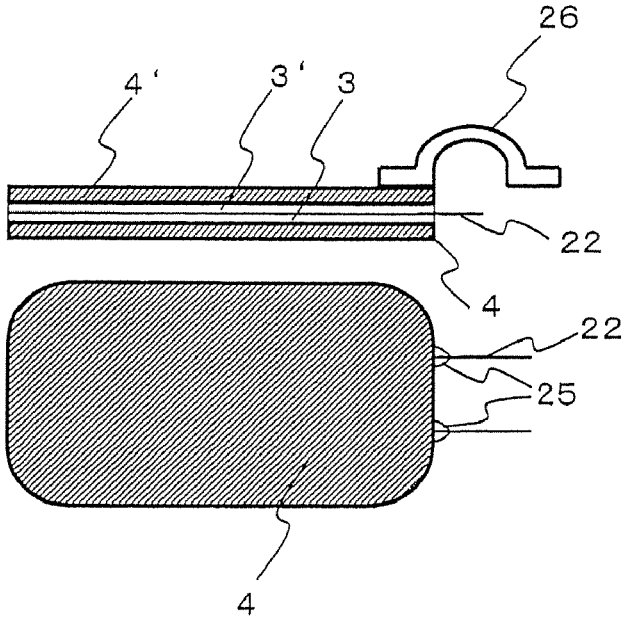
FIG. 8B is a plane and cross sectional view showing the diaphragm for planar speaker according to the first embodiment of the present invention.

FIG. 8A shows a plane and cross sectional view of a diaphragm of this embodiment including the base 4', the adhesive layer 3', another adhesive layer 3, and another base 21. The adhesive layer 3 and the base 21 differ in planar shape and dimensions from the adhesive layer 3 and the base 4 of the above-described embodiment. FIG. 8B shows a plane and cross sectional view of a diaphragm of the first embodiment described above including the bases 4 and 4' having the same planar shape and dimensions as the adhesive layers 3 and 3'.

In a diaphragm 20 for planar speaker of this embodiment, as shown in FIG. 8A, the planar shape and dimensions of the adhesive layer 3 and the base 21 are different from those of the adhesive layer 3' and the base 4'. Specifically, the adhesive layer 3 and the base 21 are shortened by a predetermined width, i.e. a width of an opening region 24, from an end 23 of one side of the adhesive layer 3', the one side being a side from which the lead lines 22 are drawn.

Figure 9A:
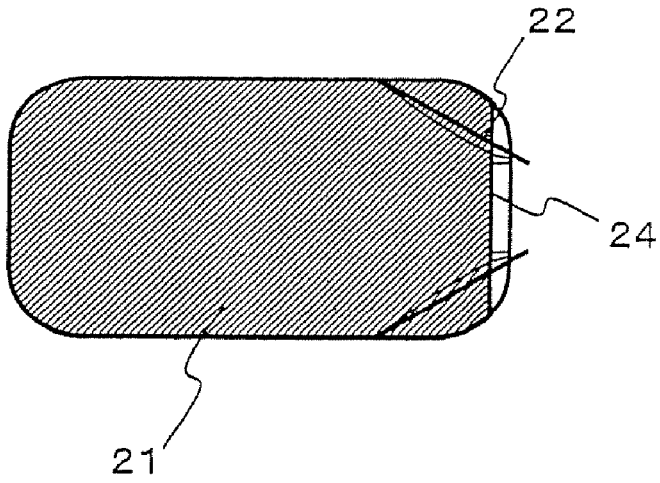
FIG. 9A is a plane view showing a diaphragm for planar speaker after extra-length treatment according to the present invention.

Each of the diaphragms 1 and 20 is subjected to an extra-length treatment after being thermally cured. In the extra-length treatment, the lead lines 22 are respectively bent at end of the diaphragm and then connected to external wirings. The diaphragms 20 and 1 after the extra-length treatment are shown in FIGS. 9A and 9B, respectively.

Figure 9B:
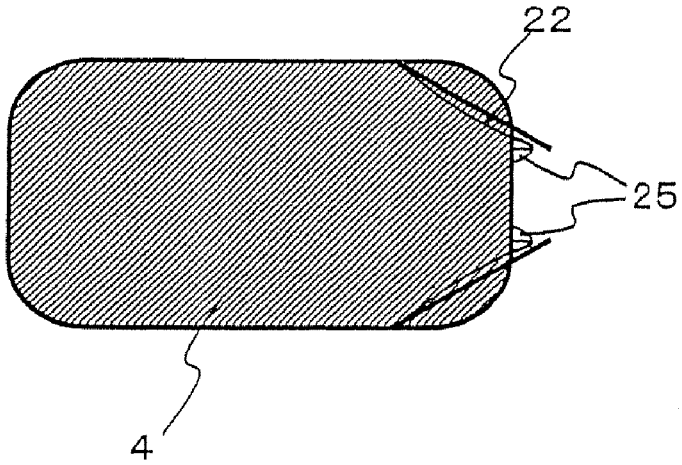
FIG. 9B is a plane view showing a diaphragm for planar speaker after extra-length treatment according to the present invention.

In the case where the bases 4 and 4' have the same planar shape and dimensions as those of the adhesive layers 3 and 3' and are bonded to the entire surfaces of the adhesive layers 3 and 3' as shown in FIG. 8B, the adhesives of the adhesive layers 3 and 3' may exude because of capillary action when curing the adhesive layers 3 and 3', and then the exuded adhesives are cured, thereby adversely forming a cured portion 25 as shown in FIGS. 8B and 9B. Formation of the cured portion leads to a difficulty of bending of the lead lines at the end 23 at a time of the extra-length treatment and may cause breakages of the lead lines 22.

In contrast, in the diaphragm 20 of this embodiment, the widths of the adhesive layer 3 and the base 21 are made smaller than those of the adhesive layer 3' and the base 4' by the predetermined width, so that the opening region 24 is provided. With this configuration, the exudation of the adhesive is prevented, and the lead lines 22 can be bent without heavy load at a time of the extra-length treatment as shown in FIG. 9A, thereby attaining an effect that the breakage can be prevented.

In order to avoid the adverse formation of the above-described cured portion 25, the predetermined width of the opening region 24 should preferably be equal to or less than an adhesive overlap width between the diaphragm and an edge of a holder for holding the diaphragm. If the predetermined width is larger than the adhesive overlap width, and thus the widths of the adhesive layer 3 and the base 21 are too short, only the base 4' and the adhesive layer 3' which are directly bonded to the edge make a contact face for the edge. In this case, the stiffness of one side, from which the lead line are drawn, of the diaphragm is lowered, and thus a stiffness balance between the one side and the other three sides of the diaphragm film becomes lower. In addition, difference in shape between the upper adhesive layer and base and the lower adhesive layer and base with the voice coil layer interposed therebetween becomes larger, resulting in deterioration of uniformity as a diaphragm for planar speaker.

The present specification is based on Japanese Patent application Nos. 2005-065682 filed Mar. 9, 2005 and 2006-059974 filed on Mar. 6, 2006. All of the content is included herein.

The invention claimed is:

1. A diaphragm for a planar speaker comprising:

a voice coil layer including a plurality of voice coils, each including a wound-wire conductor;

lead lines to draw both ends of each of the voice coils to the outside;

a first adhesive layer formed on a first side of the plurality of voice coils;

a second adhesive layer formed on a second side of the plurality of voice coils, the plurality of voice coils being entirely sandwiched between the first and second adhesive layers;

a first base bonded to a side of the first adhesive layer that is opposite the plurality of voice coils; and a second base bonded to a side of the second adhesive layer that is opposite the plurality of voice coils, the first and second adhesive layers with the voice coils therebetween being sandwiched between the first and second bases, wherein both surfaces of the first and second bases are flat, both surfaces of the first and second adhesive layers are flat, and the first and second adhesive layers include a thermosetting resin, the diaphragm being thermally cured.

2. The diaphragm for a planar speaker according to claim 1, wherein the first and second adhesive layers comprise an epoxy resin component, or alternatively one of the first and second adhesive layers comprises an epoxy resin component and the other of the first and second adhesive layers comprises an acrylic resin component.

3. The diaphragm for a planar speaker according to claim 1, wherein the first and second bases are formed of a resin foam sheet which includes at least one thermoplastic resin and has a single or multiple foam layers having microbubbles of an average bubble diameter of 50 μm or less.

4. The diaphragm for a planar speaker according to claim 1, wherein the first and second bases are formed of a sheet selected from the group consisting of:

(i) a uniform sheet including one of a plastic film, metallic foil, and fiber in a form of woven or non-woven fabric, or paper;

(ii) a sheet being formed such that the uniform sheet is impregnated or coated with a thermosetting resin and cured; and (iii) a sheet being formed such that the uniform sheet is impregnated or coated with acrylic resin in advance.

5. The diaphragm for a planar speaker according to claim 1, wherein connection portions of lead lines and external wirings are attached firmly to the one of the first and second adhesive layers or sandwiched between both the first and second adhesive layers integrally with the voice coil.

6. The diaphragm for a planar speaker according to claim 1, wherein one of the first and second adhesive layers and one of the first and second bases are shortened by a predetermined width with respect to a side of the other of the first and second adhesive layers and the other of the first and second bases from which the lead lines are drawn.

7. The diaphragm for a planar speaker according to claim 6, wherein the predetermined width is equal to or less than an adhesive overlap width between the diaphragm and an edge of a holder for holding the diaphragm.

8. A planar speaker comprising the diaphragm according to claim 1.

* * * * *